United States Patent [19]

Getsch et al.

[11] 3,967,776

[45] July 6, 1976

[54] CONTINUOUS MULTI-LAYERED PACKAGING ASSEMBLY

[75] Inventors: Edward W. Getsch, Minneapolis, Minn.; Gale N. Puerner, Fort Atkinson, Wis.

[73] Assignee: Pako Corporation, Minneapolis, Minn.

[22] Filed: Mar. 27, 1975

[21] Appl. No.: 562,507

[52] U.S. Cl. ..... 229/69; 150/39; 229/72; 282/11.5 A

[51] Int. Cl.[2] ..... B65D 27/10

[58] Field of Search ..... 229/69, 72; 150/39; 282/11.5 R, 11.5 A

[56] References Cited

UNITED STATES PATENTS

| | | | |
|---|---|---|---|
| 3,299,928 | 1/1967 | Inkley | 150/39 |
| 3,325,188 | 6/1967 | Hiersteiner | 229/69 X |
| 3,733,770 | 5/1973 | Erickson et al. | 229/69 X |

FOREIGN PATENTS OR APPLICATIONS

| | | | |
|---|---|---|---|
| 907,845 | 3/1946 | France | 282/11.5 A |

*Primary Examiner*—Stephen P. Garbe
*Attorney, Agent, or Firm*—John W. Adams

[57] ABSTRACT

This is a continuous elongated multi-layer web assembly having outer cover layers and intermediate divider layers connected along one longitudinal edge portion thereof and specifically adapted for automatic separate packaging of developed film negatives, prints and other materials for the ultimate consumer while providing individual pockets for the prints, negatives, and other materials and having spaced apart transverse severance line areas defining individual multi-pocketed packaging envelopes wherein portions of intermediate divider layers along said severance line areas are cut out to permit face to face sealing contact between the outer cover layers to define each package and also having completely severed portions which are cut through the connected edge portions of solid layers and which are respectively aligned with the transverse severance line areas to facilitate cutting along the remaining length of the severance lines to form said individual packages.

4 Claims, 5 Drawing Figures

FIG. 1
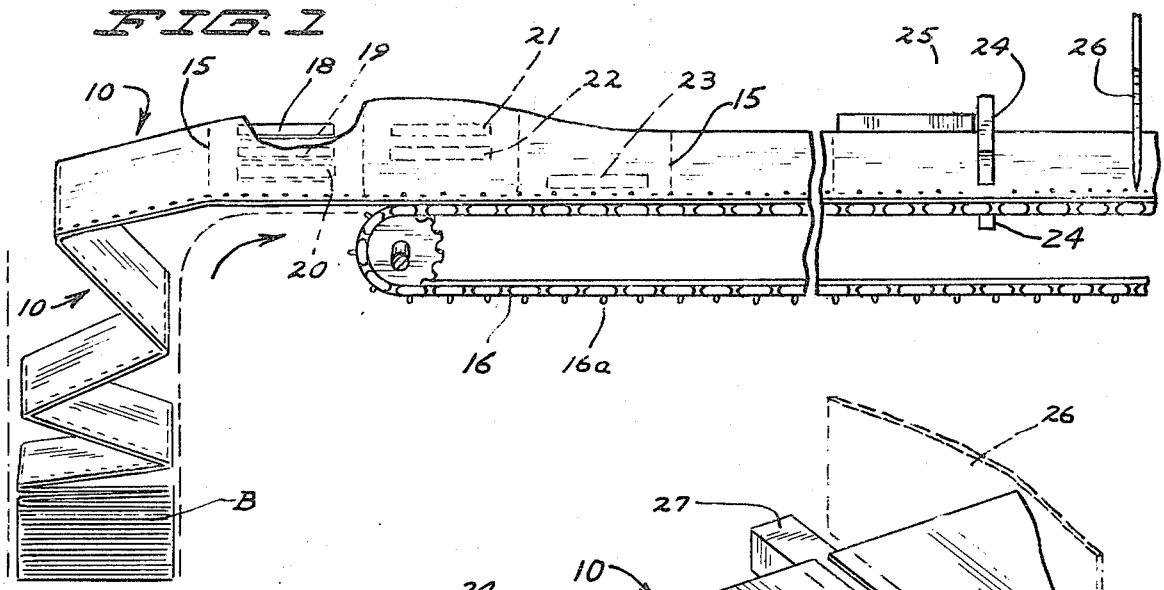
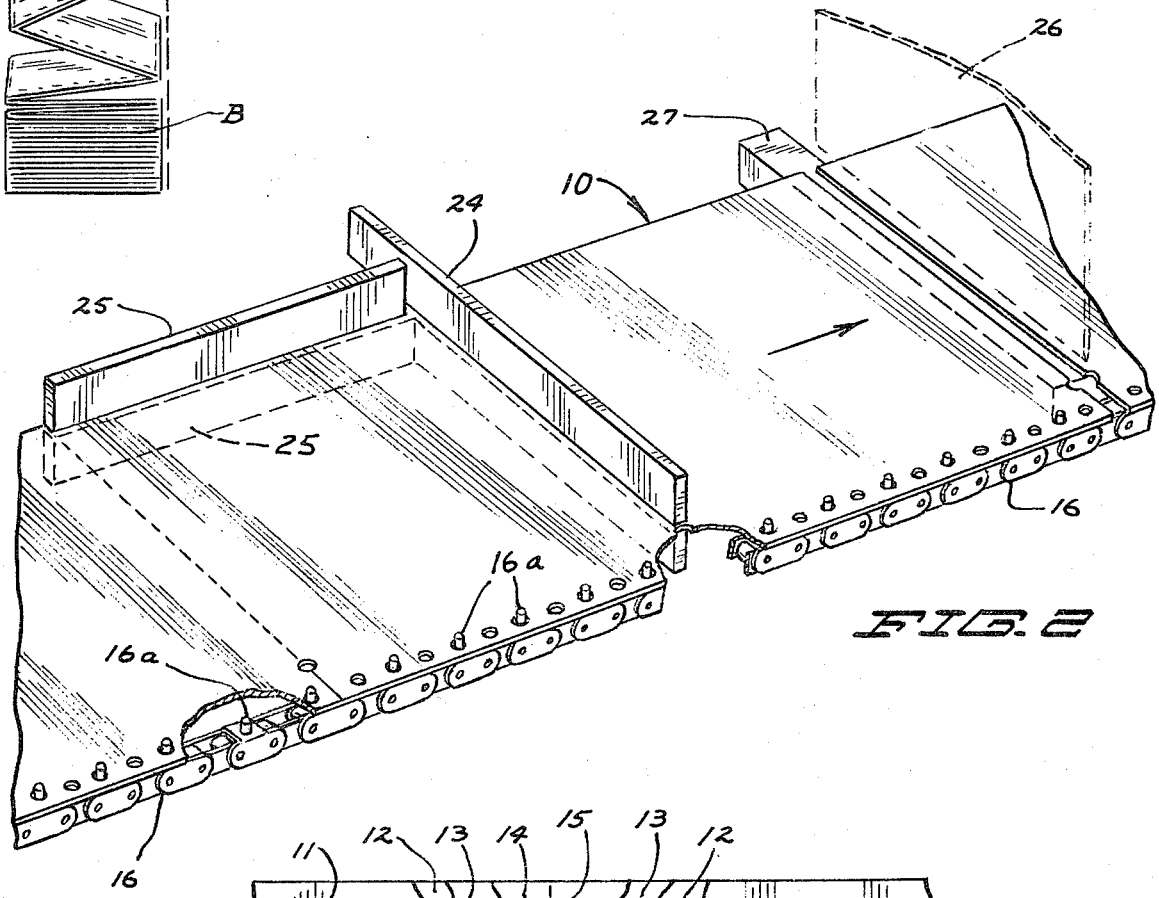
FIG. 2
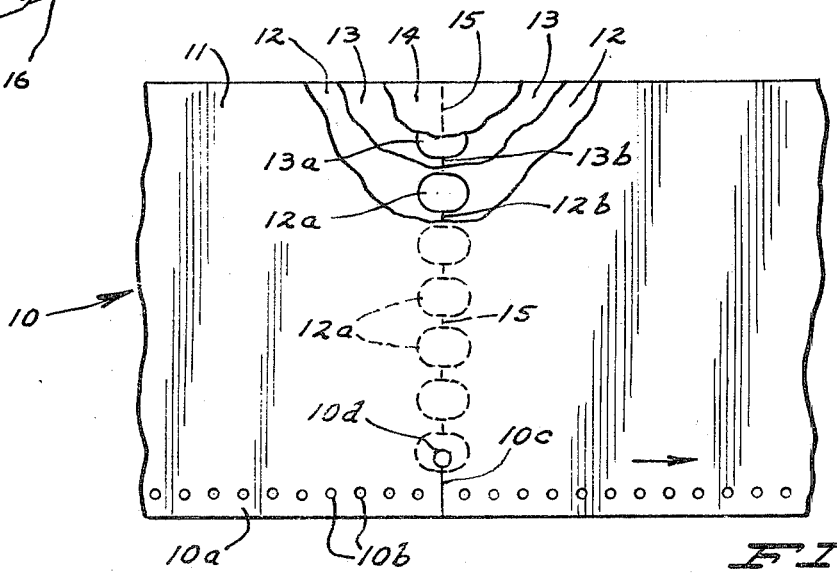
FIG. 3

CONTINUOUS MULTI-LAYERED PACKAGING ASSEMBLY

A number of different systems have previously been used to provide multiple divisions for a packaging envelope. One such system is disclosed in Erickson and Tall U.S. Pat. No. 3,733,770. In the Erickson and Tall packaging system the various divisions of a multi-layer assembly (open on three sides) are filled with the desired materials, specifically exemplified by the photographic prints in one pocket, the photographic negatives in another and other materials in a third pocket. However, the final product is specifically defined in the Erickson and Tall patent as being open on three sides even after the respective materials have been inserted therein. This open sided divider unit is then inserted into a separate envelope for delivery to the customer. This insert unit (open on three sides) is difficult to handle after insertion of the materials therein and requires a separate envelope.

It is an object of the present invention to provide a continuous elongated multi-layered web assembly having outer cover layers and intermediate divider layers all connected along one longitudinal edge portion thereof to facilitate automatic feeding and separate packaging of different materials between the respective layers thereof and specifically constructed to permit severing and sealing of the marginal edge portions along spaced transverse severance line areas to provide complete multi-compartmented packaging envelope units with the separated materials enclosed therewithin.

It is another object of the present invention to provide a continuous multi-layer packaging assembly having the layers thereof connected along one marginal edge portion and having heat sealable material on only the inner surfaces of the outer cover layers with the intermediate layers provided with spaced apart seal-through openings along spaced apart transverse severance line areas to permit face to face contact between said heat sealable inner surfaces of said outer cover layers along said severance line areas and permit a filled multi-pocketed packaging envelope sealed on all four sides to be produced.

It is still another object to provide a continuous elongated multi-layered web assembly having the layers thereof connected along one longitudinal edge portion with spaced apart transverse separation line areas to define separate multi-compartment packaging envelopes and provided with completely severed portions cut through the connected edges of said layers and respectively aligned with the transverse severance line areas to facilitate cutting the continuous multi-layer web assembly into individual package lengths.

These and other objects and advantages of this invention will be apparent from the following description made in connection with the accompanying drawing wherein like reference characters refer to similar parts throughout the several views, and in which:

FIG. 1 is a side elevational view showing diagrammatically apparatus for producing a filled and sealed multipocketed package;

FIG. 2 is a perspective view of the sealing and cut off stations of the packaging operation;

FIG. 3 is a top plan view of multi-layer assembly per se;

Figure 4:
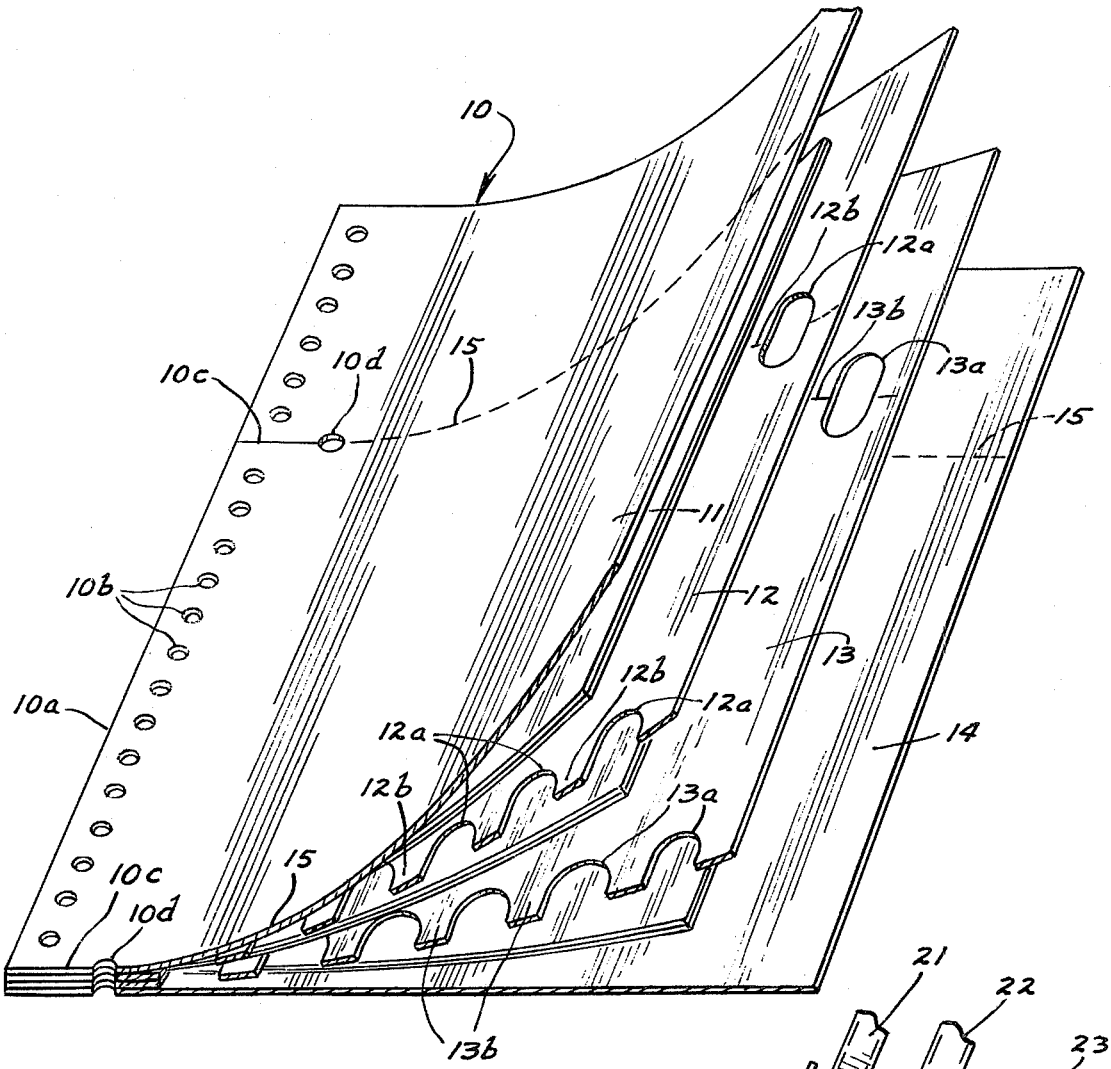
FIG. 4 is a perspective view of a portion of the assembly.

As best shown in FIG. 1 a continuous multi-layered web assembly 10 is provided. This web assembly 10 is manufactured in an accordian fold configuration which can be easily stored and can be fed to the processing machine from a supply bin B. This continuous web assembly could also be manufactured in roll form and dispensed therefrom by a suitable roll feed mechanism (not shown). As best shown in FIGS. 1 through 5 the continuous web assembly 10 includes a plurality of superimposed strips of thin sheet material such as paper or the like, which are sufficiently strong to withstand the feeding, filling and sealing stresses and produce the desired multi-pocketed package sealed on all four sides. In the form shown, four such layers are provided and they are respectively numbered 11, 12, 13 and 14. The outer layers 11 and 14 are designated as cover layers, one or both of which may be transparent, and the inner layers 12 and 13 as intermediate divider layers.

In the continuous web assembly 10 these layers are connected together only along one longitudinal marginal edge portion 10*a* with all other portions of said layers unconnected to permit the individual layers to be separated sufficiently to permit easy insertion of different items between adjacent layers of the web assembly 10. The edge 10*a* of the assembly 10 has spaced holes for driving the web through the packing, sealing and cutting operations as will be described. The individual package lengths of the web assembly are defined by spaced transverse division lines which in the form shown constitute fold lines 15 which may be formed as by perforations, which extend through the thickness of all four layers of the assembly 10.

Each of the intermediate divider layers 12 and 13 has a plurality of cut-out seal-through windows respectively designated by the reference characters 12*a* and 13*a* and disposed in underlying relation to the fold lines 15. The spacing between the windows 12*a* and 13*a* provides connecting lands respectively designated 12*b* and 13*b*. The cut-out windows 12*a* and 13*a* define edge sealing and severance areas and permit the side edges of each individual package to be closed as by being heat-sealed. The inside surfaces of the outer cover layers 11 and 14 are provided with a heat-seal coating such as polyethelene to positively attach the outer cover layers 11 and 14 to the underlying surfaces of the lands 12*b* and 13*b* and said cut-out windows permit face-to-face sealing contact of opposed portions of the heat-seal coatings of the layers 11 and 14 through said windows. This operation will be described subsequently herein at greater length.

The assembly 10 has a plurality of cuts 10*c* through all of the layers at the connected marginal edge portion 10*a* in substantial alignment with the respective transverse fold lines 15. Connecting apertures 10*d* through all of said layers intersect both the cut lines 10*c* and the respective division lines 15 to form a relatively wide cut-through opening connecting the two lines 10*c* and 15 for purposes to be brought out hereinafter. The cut line 10*c* is sufficiently long to extend inwardly beyond the width of the conveyor drive chain 16 to permit cutting off each package as will be described hereinafter.

Figure 5:
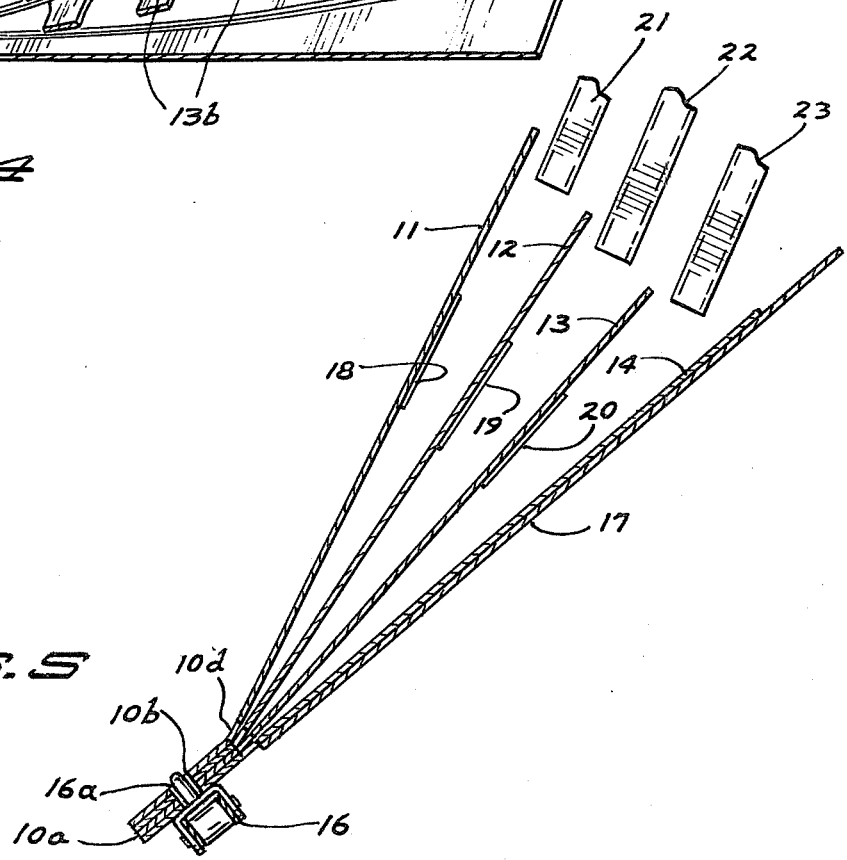
FIG. 5 is a vertical sectional view of the layers in spread apart material receiving position.

The packing, sealing and severing apparatus is shown diagrammatically in FIGS. 1, 2 and 5. The folded multi-layer web assembly 10 is stored in supply bin B and is drawn out of the bin as by a conveyor chain 16 having drive pins 16*a* extending outwardly therefrom to respectively engage selected holes 10*b* along the connected edge 10*a* of said assembly. A bottom plate 17 engages the lower cover layer 14 to support the assembly as it travels through said apparatus and is inclined upwardly from the conveyor chain 16 at an angle to facilitate insertion of the respective articles to be packaged. Separator plates 18, 19 and 20 separate the unconnected portions of the layers 11, 12 and 13 into spaced relation as best shown in FIG. 5. Delivery chutes 21, 22 and 23 respectively deliver the various articles into the pockets formed between the separated layers 11, 12, 13 and 14. The chain 16 is intermittently driven by any suitable drive mechanism (not shown) to move each package length from station to station. After the articles have been inserted into the respective pockets through the chutes 21, 22 and 23, individual packing envelopes are formed as by the pairs of heat-seal bars 24 and 25. In certain instances (to be described later) the longitudinal heat-seal bars 25 along the top edge of the assembly are not actuated to leave that edge open and permit manual insertion of certain articles into the package before final sealing. After heat-sealing, each individual package is severed as by the guillotine-type knife 26 shown diagrammatically in FIG. 2 which is reciprocated downwardly against the anvil 27 on a transverse line located substantially along the center line of the transverse sealed areas formed by the transverse bars 24.

The cut line 10*c* overlies the conveyor chain 16 and is at least slightly longer than the width of said chain, as best shown in FIG. 5. The knife 26 will sever the remaining portion of the width of each package unit without interference with the chain itself. The aperture 10*d* is located at the end of the cutting edge of the knife and is sufficiently large to insure complete severance of all of the layers across the entire width of the assembly even when the knife 26 is slightly out of register with the cut-through line 10*c*.

The seal-through windows 12*a* and 13*a* in the intermediate layers 1 and 13 permit the seal coated outer layers 11 and 14 to be sealed together by the transverse heat-seal pressure bars 24. The longitudinal heat-sealing bars 25 heat-seal the unconnected longitudinal edge portions of two outer layers 11 and 14 together, the intermediate divider layers 12 and 13 being slightly shorter than said outer cover layers 11 and 14 to permit the necessary face to face sealing contact between the longitudinal marginal edge portions of said outer layers 11 and 14.

It will be seen that we have provided a multi-layered continuous web assembly which is particularly adapted to be used in an automatic packaging machine such as the one shown diagrammatically herein to pack, seal and cut off individual multi-pocketed packages and is particularly adapted for use in the handling of photographic film and prints.

It will, of course, be understood that various changes may be made in the form, details, arrangement and proportions of the parts without departing from the scope of this invention which is defined by the appended claims.

What is claimed is:

1. A continuous multi-layer assembly for forming multipocket packages, a pair of outer cover sheets having spaced apart transverse division lines to define the sides of each individual package, intermediate sheets interposed between said cover sheets and joined together therewith along only one longitudinal edge and having cut-out seal-through windows respectively underlying said division lines to provide spaced connecting lands and open areas to provide face-to-face contact between the inner surfaces of the cover sheets through said windows, said inner cover sheet surfaces having means for adhesively sealing said cover sheets together through said windows between said lands to form individual multi-pocket packages having sealed edge portions with the edges of the intermediate sheets positively attached to said sealed edge portions by said spaced lands, said sheets being severable along said division lines to form each multi-pocket sealed package.

2. The structure set forth in claim 1 and said assembly having a plurality of uniformly spaced driving perforations through the longitudinal joined-together marginal edge portion thereof to receive conveyor drive pins therethrough to transport said assembly through a processing machine.

3. The structure set forth in claim 1 and each of said division lines having an aperture therein in closely spaced relation to the joined-together edge of said sheets, and said sheets having a cut therein completely through the joined-together portion thereof and extending transversely from said aperture outwardly to the edge of the assembly in substantial alignment with each division line.

4. The structure set forth in claim 1 wherein one of said cover sheets is transparent.

* * * * *